US009388577B2

(12) United States Patent
Kromer et al.

(10) Patent No.: US 9,388,577 B2
(45) Date of Patent: Jul. 12, 2016

(54) STRUCTURAL ELEMENT AND METHOD FOR PRODUCING A STRUCTURAL ELEMENT

(71) Applicant: Groz-Beckert KG, Albstadt (DE)

(72) Inventors: Hans Kromer, Winterlingen (DE); Roland Karle, Bisingen (DE); Hans Pfaff, Winterlingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 14/370,401

(22) PCT Filed: Dec. 21, 2012

(86) PCT No.: PCT/EP2012/076727
§ 371 (c)(1),
(2) Date: Jul. 2, 2014

(87) PCT Pub. No.: WO2013/102593
PCT Pub. Date: Jul. 11, 2013

(65) Prior Publication Data

US 2015/0033655 A1 Feb. 5, 2015

(30) Foreign Application Priority Data

Jan. 3, 2012 (DE) ..... 10 2012 100 026
Feb. 24, 2012 (DE) ..... 10 2012 101 498

(51) Int. Cl.
*E04C 2/06* (2006.01)
*E04C 2/04* (2006.01)
*E04C 2/288* (2006.01)
(Continued)

(52) U.S. Cl.
CPC . *E04C 2/06* (2013.01); *E04C 2/044* (2013.01); *E04C 2/288* (2013.01); *E04C 2/34* (2013.01); *E04C 2/50* (2013.01); *E04C 5/07* (2013.01); *E04C 5/073* (2013.01)

(58) Field of Classification Search
CPC ..... E04C 2/06; E04C 2/34; E04C 2/044; E04C 2/50; E04C 2/288; E04C 2/07; E04C 2/073
USPC ..... 52/405, 405.3
See application file for complete search history.

(56) References Cited

U.S. PATENT DOCUMENTS 1,670,557 A * 5/1928 Wettstein ..... E04C 5/07 425/DIG. 122
3,576,069 A * 4/1971 Proctor ..... E04C 2/06 264/261

(Continued)

*Primary Examiner* — Brian Glessner
*Assistant Examiner* — Paola Agudelo
(74) *Attorney, Agent, or Firm* — Leydig, Voit & Mayer, Ltd.

(57) ABSTRACT

A structural element (10) for use as a ceiling element or wall element. The structural element (10) has a facing shell (11) and a relatively thicker supporting shell (12). The facing shell (11) has a first concrete layer (14) with a textile reinforcement (15) arranged therein. The supporting shell (12) has a second concrete layer (16) and a supporting shell reinforcement (17) in the form of a box-grid structure from interconnected structural steel elements (18, 19, 20). The facing shell (11) is connected to the supporting shell (12) by a plurality of metal-free connecting bodies (24) in the form of a three-dimensional a textile grid structure (25). The textile grid structure can be produced as a woven fabric, a plait, a nonwoven fabric or a knit from carbon fibers and/or glass fiber threads that have a coating to produce the three-dimensional structure. Each connecting body (24) extends in at least two spatial planes.

18 Claims, 3 Drawing Sheets

(51) Int. Cl.

| | |
|---|---|
| ***E04C 2/34*** | (2006.01) |
| ***E04C 5/07*** | (2006.01) |
| ***E04B 5/02*** | (2006.01) |

(56) References Cited

U.S. PATENT DOCUMENTS 3,679,529 A * 7/1972 Prusinski et al. ..... 428/57
5,148,645 A * 9/1992 Lehnert ..... B28B 11/04 156/42
5,387,455 A * 2/1995 Horsch ..... 428/116
5,459,970 A * 10/1995 Kim ..... E04B 1/165 52/379
5,685,116 A * 11/1997 Bradshaw et al. ..... 52/311.1
5,802,793 A * 9/1998 DeVore, Jr. ..... 52/424
2002/0182953 A1* 12/2002 Porter ..... 442/4
2003/0208987 A1* 11/2003 Lancelot et al. ..... 52/797.1
2004/0134158 A1* 7/2004 Farrell, Jr. ..... E04B 2/845 52/664
2008/0041004 A1* 2/2008 Gibbar et al. ..... 52/309.12
2014/0087158 A1* 3/2014 Ciuperca ..... 428/215

* cited by examiner

STRUCTURAL ELEMENT AND METHOD FOR PRODUCING A STRUCTURAL ELEMENT

FIELD OF THE INVENTION

The present invention relates generally to structural elements and a method of production, and particularly to structural elements that can be used as wall or ceiling elements.

BACKGROUND OF THE INVENTION

The structural elements to which the present invention is directed are factory-produced and transported as prepared, such as board-shaped structural elements to the construction site for installation at that location. The structural element preferably has a rectangular, and in particular square form. It can have a curved or arched form, also with corners. The edge length of the structural element can be several meters. The structural element has a facing shell with a first concrete layer, as well as a supporting shell with a second concrete layer. The facing shell is connected to the supporting shell by several connecting bodies. The facing shell mainly serves the purpose of providing the visual appearance of the structural element and ensuring weather protection as an outer building skin, while the supporting shell serves to support forces introduced into the structural element as a function of the required statics. Insulating material can be provided between the facing shell and the supporting shell.

A structural element, which can serve as wall or ceiling element, for example, is known from DE 100 07 100 A1. Trusses made of stainless steel, black steel or galvanized steel are used to connect the supporting shell to the facing shell. Such steel connecting bodies can absorb forces introduced into the facing shell and support via the supporting shell. However, steel connecting bodies have the disadvantage that the production of steel requires an extremely high use of energy and is costly. In addition, thermal bridges are created between the facing shell and the supporting shell.

A similar structural element, which is designed as wall element, is known from DE 100 59 552 A1. Double claw elements are used therein to connect the facing shell to the supporting shell. In so doing, a larger distance is possible between facing shell and supporting shell for a thicker insulating layer. The double claw elements are preferably made of metal and, in particular, steel. The same heat expansion coefficient will result for the claw elements and for the supporting shell, if the latter is made of reinforced concrete.

A pipe element as a sandwich composite panel is further known from DE 29 39 877 U1. To connect the two outer shells by means of an insulating layer located therebetween, linear anchoring elements are used in different embodiments.

A textile concrete element is known from DE 202 07 945 U1. A textile reinforcement in the form of a three-dimensional textile structure is present therein. Provision is made between the supporting shell and the facing shell for common anchoring rods.

Finally, EP 0 532 140 A1 describes a structural element comprising a facing shell and a supporting shell, wherein reinforcing strands, which are pretensioned in each case, are introduced in both shells. The reinforcing strands are connected to one another with the help of connecting bodies. These connecting bodies can be made of a fiber-reinforced composite material, which includes a plastic.

OBJECTS AND SUMMARY OF THE INVENTION

It is an object of the invention to provide an improved structural element that can be used in connection with high static loads, yet lends itself to efficient and economical manufacture.

The subject structural element has a facing shell with a first concrete layer and textile reinforcement arranged in the first concrete layer. The textile reinforcement preferably extends in a plane parallel to the outer surface of the facing shell. For example, the textile reinforcement can be in the form of a flat knit, plait, woven fabric or nonwoven fabric, the spatial expansion of which is preferably larger in an extension plane than in the spatial direction at a right angle to the extension plane. The dimensioning of the reinforcement is a function of the static demands. The textile reinforcement can therefore have a substantially two-dimensional form. However, it is also possible for the textile reinforcement to encompass a three-dimensional form.

A supporting shell with a second concrete layer is provided at a distance to the facing shell. A supporting shell reinforcement is located in this second concrete layer. In one embodiment, the supporting shell reinforcement can consist of a different material than the textile reinforcement of the facing shell. In particular, the supporting shell reinforcement may be made of metal, for example of steel. In the alternative, provision can be made for textile material, for example a knit, plait, woven fabric or nonwoven fabric, for the supporting shell reinforcement. The static load of the structural element is accommodated and supported by the supporting shell. Typically, the facing shell, which is spaced apart from the supporting shell, serves to accommodate small loads and in particular to improve the optical impression of the structural element as well as for weather protection. For example, it covers an insulating layer, which is arranged between the supporting shell and facing shell. Due to the flat and light textile reinforcement in the facing shell, the latter can be embodied so as to be particularly thin and therefore particularly light.

Separate connecting bodies are arranged between the textile reinforcement and the supporting shell reinforcement. The connecting bodies have a rigid three-dimensional form and are formed by means of a three-dimensional textile grid structure, which is in particular free from metallic elements. The connecting bodies are thus not designed as massive closed bodies, but as grid bodies with a plurality of through holes or meshes, respectively. The connecting bodies are thus very light. They have an inferior heat conduction and thus do not form thermal bridges between the facing shell and the supporting shell. In addition, such connecting bodies of a three-dimensional textile grid structure can be produced easily and can be handled equally easily in response to the production of the structural element. For example, the three-dimensional textile grid structure can be produced by angling and/or bending of a textile grid, which extends in a planar manner in a plane and by fixing the curved and/or angled textile grid in the desired shape. The textile grid can thereby be brought into the desired three-dimensional shape and can be fixed, for example by means of heat impact and/or by means of a coating, for example with a resin. Due to the grid structure, the connecting body connects very well to the two concrete layers. To provide the desired position of the connecting body prior to pouring the concrete layers, said connecting body can be connected very easily to the textile reinforcement due to its grid structure, for example by means of tie wire or cable ties by way of the textile grid structure can encompass glass and/or carbon fibers.

Preferably, each connecting body encompasses a constant cross sectional contour in its direction of extension. The connecting body can thus be produced as longitudinal element and can be cut off easily in the required length for the structural element. In the alternative, it is also possible to initially trim a flat textile grid in the desired length and to subsequently produce the three-dimensional textile grid structure therefrom and thus the connecting body by bending and/or angling and fixing in the desired shape.

In the case of a preferred embodiment, each connecting body has at least two grid sections, which extend in different spatial planes. In particular, two adjacent grid sections are aligned at a right angle to one another. In one embodiment, each connecting body has a first grid section as well as a second grid section, which are arranged parallel to one another and at a distance. A third grid section is oriented at a right angle to the first and to the second grid section and connects the first grid section to the second grid section. Preferably, a connecting body comprising a U-shaped cross section is created in this manner. In this embodiment, the first and the second grid section extend in a respective concrete layer, whereas the third grid section bridges the distance between the two concrete layers. In its extension plane, the third grid section can support the forces which are introduced into the facing shell very well and can transfer them into the supporting shell.

In this embodiment, it is possible to place two connecting bodies against one another with their respective third grid sections or to connect them to one another indirectly via a reinforcing element. The reinforcing element is optional. It can preferably extend along the entire surface of the two grid sections of the two connected connecting bodies. In particular, the third grid sections of the two connecting bodies are of equal size. If two connecting bodies are arranged against one another in this manner, the respective first grid sections extend in opposite directions, originating at the assigned third grid section. The respective second grid sections also extend away from one another in opposite directions from the respective third grid section. As a whole, a connecting body arrangement comprising an I-shaped cross section, the cross sectional shape of which can also be identified as double T-shape, is created. If a reinforcing element is arranged between the two third grid sections, the forces, which can be accommodated, can thus be increased. The reinforcing element can encompass a board-shaped design, wherein the thickness is preferably less than 1 cm and can be between 0.5 and 0.7 cm, for example.

In the case of the preferred exemplary embodiment, each connecting body extends parallel to an assigned longitudinal or transverse edge of the structural element. The direction of extension of a connecting body is to be understood as the direction, in which the grid section, which connects the two concrete layers, extends parallel to the plane of the two concrete layers.

In particular, a plurality of connecting bodies of a first group extend in a longitudinal direction continuously along the entire structural element. Preferably, provision is additionally made for a second group of connecting bodies, which extend at an angle or in a transverse direction, transverse to the longitudinal direction between the connecting bodies of the first group. This results in a structural element, which can support forces, which are introduced into the facing shell both in longitudinal direction as well as in transverse direction very well via the supporting shell.

The production of the above-described structural element is carried out by means of the method according to the following steps.

A textile reinforcement for the facing shell is arranged on a formwork table. The connecting bodies are provided. The connecting bodies are connected to the textile reinforcement so as to fix the position. Subsequently, the concrete layer of the facing shell is poured. An insulating layer is then arranged between the connecting bodies on the first concrete layer, which preferably has not yet hardened. The supporting shell reinforcement is placed onto this insulating layer and the concrete layer thereof is poured subsequently. Both concrete layers harden.

Preferably, a tiltable formwork table is used for producing the structural element. After both concrete layers have hardened, the formwork table is tilted, for example about an angle of between 45° and 90°, preferably by 70°, so that the finished structural element can be removed in an upright manner, for example with the help of a crane.

Other objects and advantages of the invention will become apparent upon reading the following detailed description and upon reference to the drawings, in which:

Figure 1:
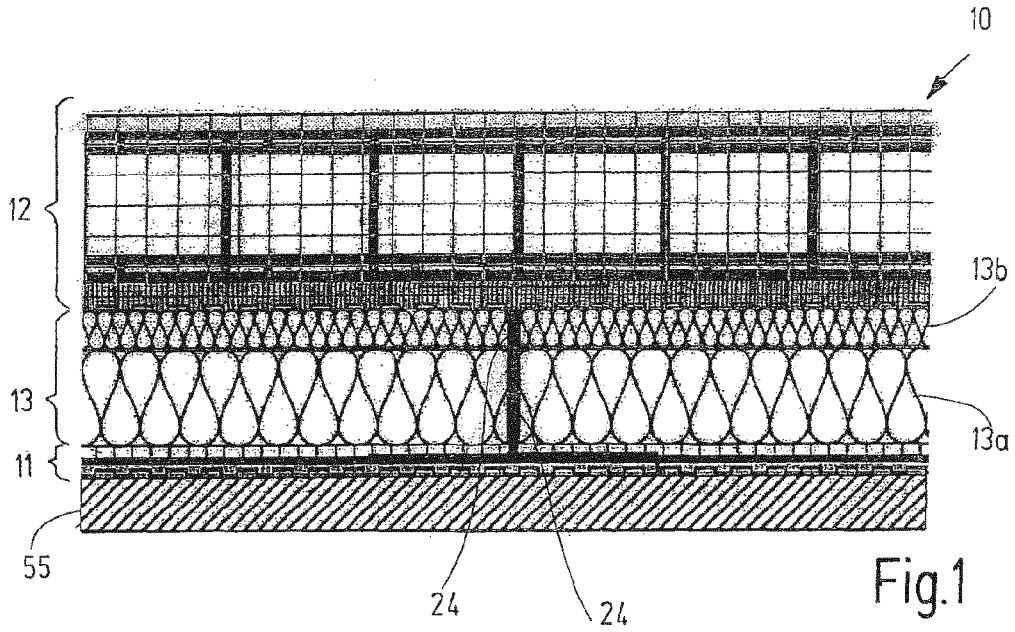
FIG. 1 is a schematic vertical section of an illustrative embodiment of structural element according to the invention.

While the invention is susceptible of various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENTS

Figure 2:
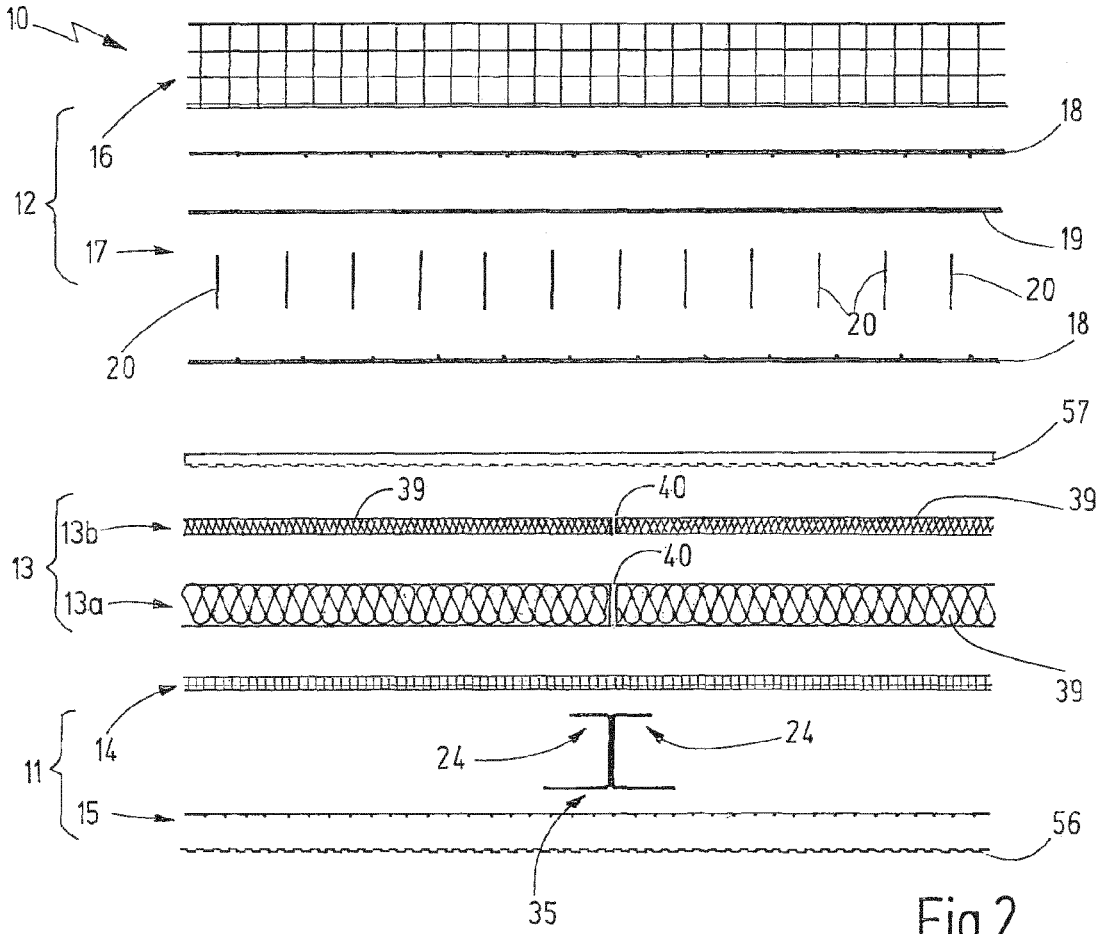
FIG. 2 is an exploded vertical section of the structural element shown in FIG. 1.

Referring now more particularly to FIGS. 1 and 2 of the drawings, there is shown in illustrative structural element 10 in accordance with the invention. The structural element 10 has a facing shell 11, a supporting shell 12, and an insulating layer 13 arranged between the facing shell and the supporting shell. The insulating layer 13 can be formed by a plurality of insulating layers with the same or different thickness. As required, the insulating layers can consist of a different material. In the exemplary embodiment, provision is made for a first insulating layer 13*a* and for a second insulating layer 13*b* which preferably rest directly against one another. The stacks of the insulating layers 13*a*, 13*b* can be offset to one another. Connecting bodies 24 are arranged in position and/or are spaced apart from one another such that common insulating board measurements can be used. If the insulating layer 13 consists only of a single insulating layer, the stack is formed by means of a shiplap, i.e. tongue and groove. Adjacent structural elements 10 can thus be connected to one another very easily.

The facing shell 11 includes a first concrete layer 14 in which a textile reinforcement 15 is arranged. The textile reinforcement 15 may be in the form of a knit, plait, woven fabric or nonwoven fabric. The textile reinforcement has a mesh or grid structure. It extends parallel to the first concrete layer 14 substantially in a plane. It is understood that the individual filaments of the textile reinforcement 15 do not need to run exactly in one plane, but can form bends and/or loops around other filaments, as is common in the case of a woven fabric, plait, or knit. The textile reinforcement 15 in this case has a two-dimensional flat profile. In the alternative, 3D textiles, for example knit spacer fabric or other textile elements comprising a three-dimensional shape can be used. The thickness of the textile reinforcement 15, measured transverse to the extension plane, is preferably maximally 2 to 3-times the thread thickness. The facing shell can thus have a very small thickness. In the case of the exemplary embodiment, the facing shell has a total thickness of 3 cm. The weight of the facing shell is thus low. The surface of the facing shell 11, which faces away from the insulating layer 13, forms the outer surface of the structural element 10.

The first insulating layer 13*a* is adjacent to the first concrete layer 14 of the facing shell 11 and the second insulating layer 13*b* is adjacent thereto. The two insulating layers 13*a*, 13*b* can be made of different materials and/or can have different thicknesses. Polyurethane boards and/or polystyrole boards and/or mineral wool mats, for example, can be used as insulating material.

The supporting shell 12 of the structural element 10, which represents the inner wall side of the structural element 10, is adjacent to the insulating layer 13. The supporting shell 12 has a second concrete layer 16, in which a supporting shell reinforcement 17 is arranged. In the exemplary embodiment, the supporting shell reinforcement 17 is made of steel elements. As can in particular be seen in FIG. 2, the supporting shell reinforcement 17 has two construction steel mats 18, which extend parallel to one another and which are connected to one another via rod-shaped elements 19 and/or U-shaped elements 20 and which form a box-shaped grid structure. The supporting shell 12 can accommodate large static loads due to the second concrete layer 16, which is provided with a steel reinforcement.

A plurality of connecting bodies 24 are arranged between the supporting shell reinforcement 17, the supporting shell 12 and the textile reinforcement 15 of the facing shell 11. Each connecting body 24 is connected to the first concrete layer 14 as well as to the second concrete layer 16. A section of each connecting body 24 therefore permeates the insulating layer 13.

The thickness of the supporting shell 12 preferably is five to ten times and in particular six to seven times, larger than the thickness of the facing shell 11. In the case of the exemplary embodiment, the thickness of the insulating layer 13 is fourteen centimeters. According to the example, the thickness of the supporting shell 12 is twenty centimeters. The thickness of the facing shell 11 is three centimeters, for example.

Figure 3:
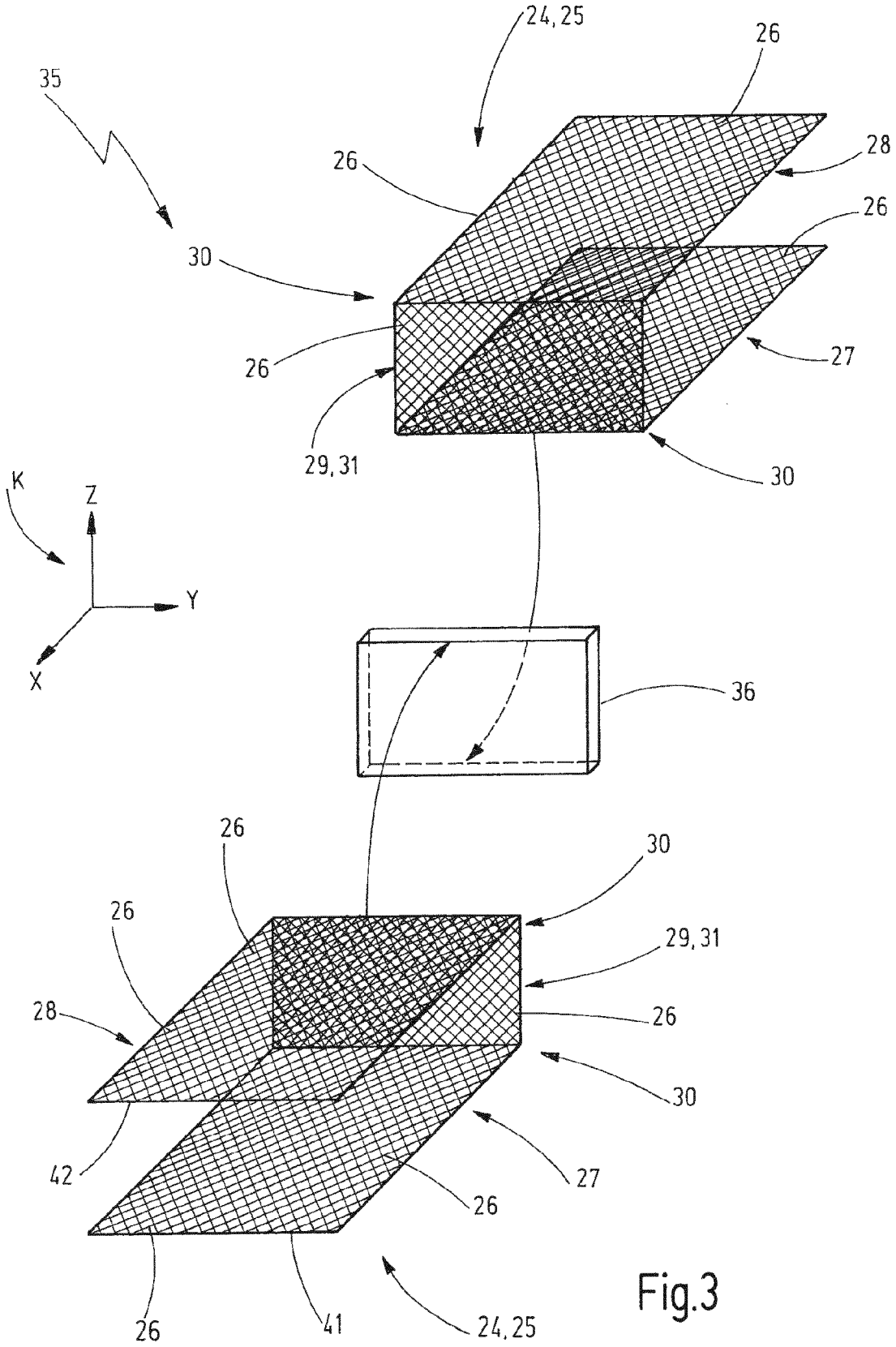
FIG. 3 is an exploded perspective of an illustrative connecting body arrangement included in the structural element shown in FIGS. 1 and 2.

An exemplary embodiment for a connecting body 24 is illustrated schematically in FIG. 3. Each connecting body 24 is formed by means of a three-dimensional textile grid structure 25. The textile grid structure 25 has filaments or threads 26, respectively, which are arranged so as to cross or intertwine such that openings or apertures, respectively, are formed. The formation of these openings can be attained by means of a plait, a knit, a plait, a nonwoven fabric or a woven fabric. The threads 26 can be made of glass fibers or carbon fibers, for example. The threads 26 can also be glued to one another.

In the case of the preferred exemplary embodiment, each connecting body 24 has a plurality of grid sections 27, 28, 29. At least two grid sections 27 and 29 or 28 and 29, respectively, extend in different spatial planes x-y and y-z based on the planes x-y, x-z and y-z of a Cartesian coordinate system K. The three-dimensional textile grid structure 25 of the connecting body 24 is obtained, for example, in that the individual grid sections 27, 28, 29, which in each case run in a plane x-y or y-z, respectively, are bent over or angled, respectively, at one or a plurality of bending points 30, originating from a flat two-dimensional textile grid. A bending point 30, at which the two grid sections 27, 29 or 28, 29, respectively, merge into one another without seams or joints, is present in each case between two adjacent grid sections 27, 29 or 28, 29, respectively.

According to the example, the threads 26 extend at an angle to the side edges of the respective grid section 27, 28, 29. In use position of the structural element 10, the threads 26 are arranged at an angle to the vertical direction. Static loads can thus be accommodated better. For example, the threads 26 can run at an angle of between 40 and 50° relative to the side edge of the grid section 27, 28, 29 or in use position at an angle of between 40 and 50° relative to the vertical direction, respectively. This angle can preferably be 45°. In the alternative, the threads 26 can also run parallel to the side edges.

In the case of the exemplary embodiment illustrated herein, each connecting body 24 encompasses a first grid section 27 and a second grid section 28, which extend parallel to one another. The first grid section 27 is arranged within the first concrete layer 14 and the second grid section 28 is arranged within the second concrete layer 16. A third grid section 29 connects the first grid section 27 to the second grid section 28. The third grid section 29 runs approximately at a right angle to the two other grid sections 27, 28. The third grid section 29 thus forms a connecting web 31 between the first grid section 27 and the second grid section 28. Originating at this connecting web 31, the first grid section 27 and the second grid section 28 extend away in the same direction parallel to one another. In a side view or in cross section, respectively, of the structural element 10, the textile grid structure 25 or the connecting body 24, respectively, encompasses a U-shaped design.

To increase the stability of the structural element 10, two connecting bodies 24 are connected to one another to form a connecting body arrangement 35. For this purpose, the two connecting webs 31 are either placed directly against one another or are connected to one another with the help of a reinforcing element 36, which is arranged therebetween. In the case of the preferred exemplary embodiment, the reinforcing element 36 has a board-shaped design. Its use is optional and can contribute to further reinforce the connecting webs 31, which are formed by means of the third grid sections 29. The two connecting bodies 24 are placed against one another such that, originating at the respective connecting web 31, the two first grid sections 27 run in the same plane x-y and extend away from the connecting web 31, originating at the respective other connecting body 24. Accordingly, the two second grid sections 28 also extend in the same plane x-y and extend away from the respective other connecting body 24, originating at the connecting web 31. An I-shaped or double T-shaped design of the connecting body arrangement 35 thus follows in the side view or in cross section, respectively.

The connecting webs 31 and optionally the reinforcing element 26 arranged therebetween completely permeate the insulating layer 13. For this purpose, the insulating layer 13 or each insulating layer 13*a*, 13*b*, respectively, is divided into individual segments 39, for example individual boards or mats, so that the connecting webs 31 or the reinforcing element 36, respectively, can extend through a gap 40 between the individual segments 39 of the insulating layer 13 or of the insulating layers 13*a*, 13*b*, respectively, The segments 39 are cut to size and are placed between the connecting bodies 24 as a function of the distance between the connecting bodies 24 or the connecting body arrangements 35 of the structural element 10, respectively.

As can in particular be seen in FIGS. 2 and 3, the length of the first grid section 27, originating at the third grid section 29, to its free end 41, is larger than the length of the second grid section 28, originating at the third grid section 29, to its free end 42. In the alternative, this could also be reversed. It is also possible to embody the two grid sections 27, 28 so as to have the same length.

The connecting body 24 in this case is free from metal parts. The facing shell 11 does not contain any reinforcing parts made of metal. Only metallic tie wire is present in the facing shell 11 for fixing the position of the connecting bodies 24 for pouring the first concrete layer. The tie wire is in particular made of rustproof material, preferably a rustproof metal alloy. According to the example, the facing shell 11 is otherwise free from metallic components. The weight of the facing shell 11 as well as of the connecting bodies 24 is thus low. Due to the metal-free connecting bodies 24, a thermal bridge is furthermore avoided between the supporting shell 12 and the facing shell 11.

Figure 4:
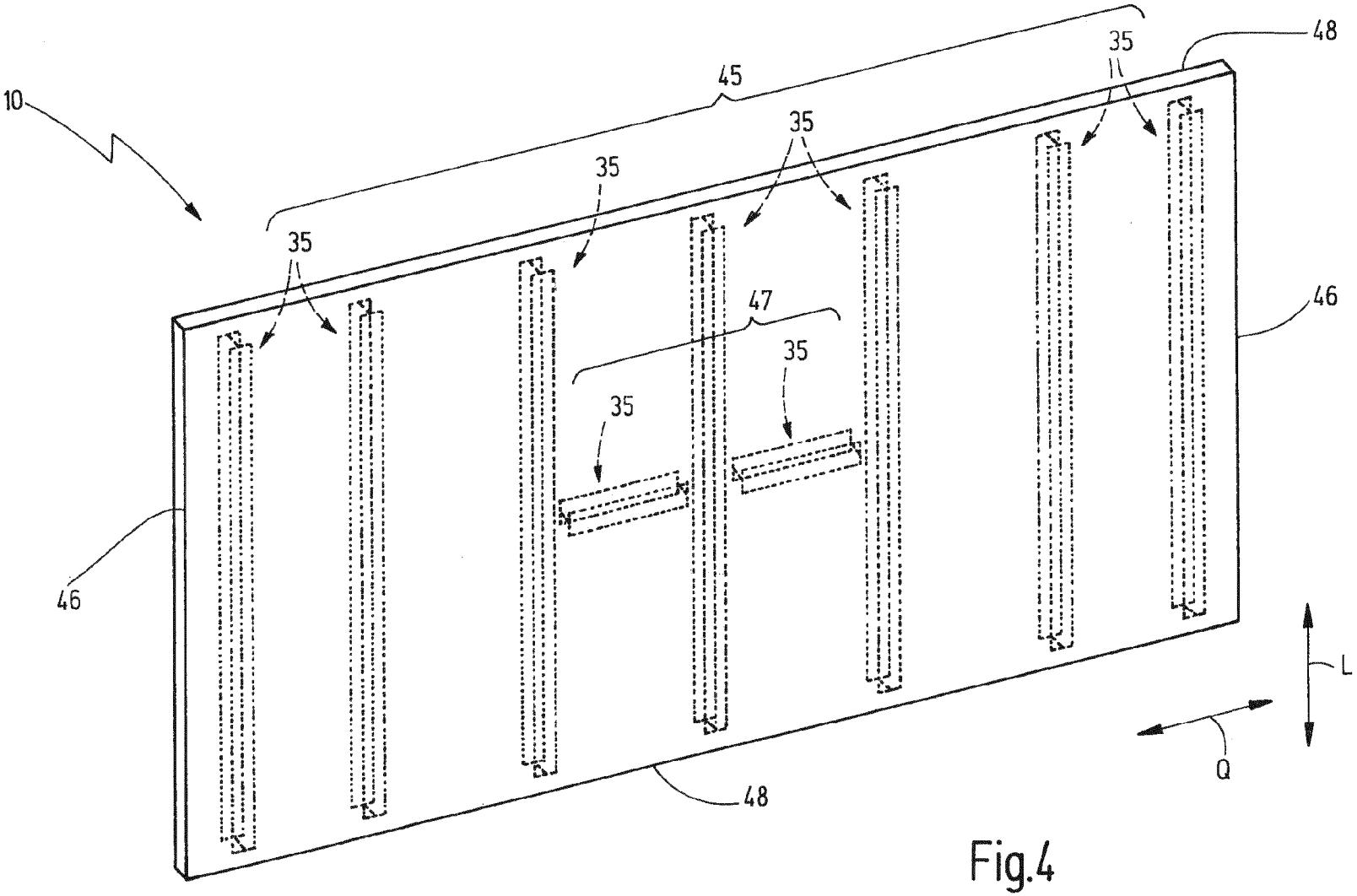
FIG. 4 is a perspective illustrating an arrangement of connecting bodies in the illustrated structural element.

To improve the stability of the structural element 10, the latter has a first group 45 of connecting bodies 24 or connecting body arrangements 35, which extend in a longitudinal direction L parallel to the longitudinal edges 46 of the structural element 10 (FIG. 4). The position of the connecting bodies or of the connecting body arrangements 35, respectively, is illustrated schematically in FIG. 4. The shape of the connecting body 24 is as described above. In the case of the preferred exemplary embodiment, seven connecting body arrangements 35 run in an interruption-free manner in longitudinal direction L and are arranged transverse to the longitudinal direction L in a transverse direction Q at a distance to one another. The connecting bodies 24 end at a distance to the transverse edges 48 of the structural element 10.

Optionally, a second group 47 of connecting bodies 24 or connecting body arrangements 35 can furthermore be present as a function of the size of the structural element 10. This second group 47 is arranged in the area of the center of gravity of the structural element 10 and thus in the area of the board center, because large loads, for example wind loads, can appear at that location. The connecting bodies 24 or the connecting body arrangements 35, respectively, of the second group 47 extend in transverse direction Q transverse to the longitudinal direction L parallel to the two transverse edges 48 of the structural element 10. The connecting body arrangements 35 or the connecting bodies 24, respectively, of the second group 47, in each case run between two connecting bodies 24 or connecting body arrangements 35 of the first group 45 and, according to the example, are spaced apart from the adjacent connecting bodies 24 of the first group 45. In the alternative, the connecting bodies 24 of the second group 47 can also abut on the connecting bodies of the first group 45. In the case of the exemplary embodiment, the connecting bodies 24 or the connecting body arrangements 35, respectively, of the second group 47 form a single row, which runs in transverse direction Q, in each case comprising a plurality of—according to the example comprising two—connecting bodies 24 or connecting body arrangements 35, respectively.

The connecting bodies 24 of the second group 47 therefore do not extend continuously along the structural element 10 parallel to the transverse edges 48 in transverse direction Q, but in each case area by area between the connecting bodies 24 of the first group 45, which run continuously in longitudinal direction L.

The number of the connecting bodies 24 or of the connecting body arrangements 35, respectively, of the first group 45 as well as of the second group 47 is a function of the length of the longitudinal edges 46 or of the transverse edges 48, respectively, of the structural element 10. The distance between two adjacent connecting body arrangements 35 in longitudinal direction L and/or in transverse direction Q can be regular or irregular. In the case of the connecting body arrangements 35, which run in longitudinal direction L, the distance of connecting body arrangements 35, which run in the same direction, can be different, for example, than in the case of the connecting body arrangements 35, which run in transverse direction Q. In the case of the exemplary embodiment, provision is made on the respective six meter length of the transverse edges 48 of the structural element 10 for seven connecting body arrangements 35, which extend in longitudinal direction L, while only one row comprising two connecting body arrangements 35 extends in transverse direction Q in the case of a length of the longitudinal edges 46 of four meters.

The position of the connecting bodies 24 or of the connecting body arrangements 35, respectively, can also be determined by the required openings in the structural element 10. For example, openings or sections in the structural element 10 can be necessary, so as to arrange windows, doors or other passages, such as inlet air and outlet air openings. In these cases, a connecting body 24 made of textile is installed circumferentially around the opening. Openings, which are introduced subsequently into the structural element 10 by means of drilling or sawing, are not critical with regard to corrosion problems to a certain extent, because rustproof construction steel is used.

The structural element 10 is produced as follows:

A first spacer element 56 is initially arranged on a formwork table 55. This first spacer element 56 determines the distance between the textile reinforcement 15 of the facing shell 11 and the outer surface of the facing shell 11 or of the structural element 10, respectively. The first spacer element 56 has through holes, through which the concrete for the first concrete layers 14 can flow in response to the pouring and can thus surround the first spacer element 56 in this manner. The first spacer element 56 can be embodied in a mat-shaped manner.

The textile reinforcement 15 is placed onto the first spacer element 56. The textile reinforcement 15 which in this case is in the form of a flat grid structure extends substantially in a plane parallel to the outer surface of the structural element 10. The connecting bodies 24 and, in the case of the exemplary embodiment, the connecting body arrangement 35, which in each case consists of two connecting bodies 24, are placed onto the textile reinforcement 15. The first grid sections 27 of each connecting body 24 thereby rest in each case on the textile reinforcement 15. The connecting bodies 24 are in each case connected to the textile reinforcement 15 at least at one connecting point with the help of tie wire, cable ties, plastic bands, stainless steel wire, clamps, adhesive or other suitable fastening means. The position of the connecting bodies 24 or of the connecting body arrangements 35, respectively, are fixed relative to the textile reinforcement 15 in that manner.

Subsequently, the concrete for the first concrete layer 14 is poured so that the first concrete layer 14 completely surrounds the textile reinforcement 15 as well as the first grid sections 27 of each connecting body 24.

The segments 39 of the insulating layer 13 and, according to the example, of the first insulating layer 13*a* and subsequently of the second insulating layer 13*b* are inserted between the connecting body arrangements 35 and, more precisely, into each of the boxes 50 formed by means of the adjoining connecting webs 31. This can take place as long as the first concrete layer 14 has not yet hardened, if a firmly bonded connection is to be attained between the insulating layer 13 and the first concrete layer 14.

As an alternative to fixed insulating boards, the insulating layer 13 can also be applied to the first concrete layer 14 by foaming. In that case, the insulating layer 13 can be made of in situ foam.

A second spacer element 57, which analogous to the first spacer element 56, is subsequently placed onto the insulating layer 13. The thickness of the second spacer element 57 can differ from the thickness of the first spacer element 56. The second spacer element 57 defines the distance of the supporting shell reinforcement 17 from the insulating layer 13. The supporting shell reinforcement 17 is placed onto the second spacer element 57. The concrete for the second concrete layer 16 is cast on subsequently so that said concrete surrounds the supporting shell reinforcement 17 and, according to the example, the spacer element 57 as well.

After the two concrete layers 14, 16 have hardened, the formwork table 55 is inclined or tilted, respectively, according to the example by approximately 70°. The finished structural element 10 then can be removed in an upright manner, for example via a crane or another means of transport.

Form the foregoing, it can be seen that the structural element 10 according to the invention can be used as ceiling element or wall element. The structural element 10 has a facing shell 11 and a supporting shell 12, which is at least five times thicker. The facing shell 11 has a first concrete layer 14 with a textile reinforcement 15 arranged therein. The facing shell 11 is free from metal reinforcement elements made of metal. The supporting shell 12 has a second concrete layer 16, in which a supporting shell reinforcement 17 is provided, which is formed in particular as a box-grid structure from structural elements 18, 19, 20, which are connected to one another. The facing shell 11 is connected to the supporting shell 12 by a plurality of metal-free connecting bodies 24. Each connecting body 24 is formed by a textile grid structure 25, which is shaped as a three-dimensional profile part. The textile grid structure can be produced as a woven fabric, a plait, a nonwoven fabric or a knit from carbon fibers and/or glass fiber threads and can have a coating to produce the three-dimensional structure. Each connecting body 24 extends in at least two spatial planes x-y and y-z of the three spatial planes in a Cartesian coordinate system K.

LIST OF REFERENCE NUMERALS

10 structural element
11 facing shell
12 supporting shell
13 insulating layer
13*a* first insulating layer
13*b* second insulating layer
14 first concrete layer
15 textile reinforcement
16 second concrete layer
17 supporting shell reinforcement
18 construction steel mat
19 rod
20 bracket
24 connecting body
25 textile grid structure
26 thread
27 first grid section
28 second grid section
29 third grid section
30 bending point
31 connecting web
35 connecting body arrangement
36 reinforcing element
39 segment
40 gap
41 free end of the first grid section
42 free end of the second grid section
45 first group
46 longitudinal edges
47 second group
48 transverse edge
50 box
55 formwork table
56 first spacer element
57 second spacer element
K coordinate system
L longitudinal direction
Q transverse direction
x-y spatial plane of the coordinate system
x-z spatial plane of the coordinate system
y-z spatial plane of the coordinate system

The invention claimed is:

1. A structural element (10) comprising
a facing shell (11) having a first concrete layer (14) and a textile reinforcement (15),
a supporting shell (12) having a second concrete layer (16) and a supporting shell reinforcement (17),
a plurality of connecting bodies (24) arranged between the textile reinforcement (15) and the supporting shell reinforcement (17) and connected to the supporting shell (12) as well as to the facing shell (11), and
said connecting bodies (24) each having a three-dimensional textile grid structure (25), wherein each said connecting body (24) has at least two grid sections (27, 28, 29) which extend in different spatial planes.

2. The structural element (10) of claim 1 in which each said connecting body (24) is a bent textile grid.

3. The structural element (10) of claim 1 in which each said connecting body (24) has a first grid section (27) and a second grid section (28) which extend parallel to one another and a third grid section (29) which connects the first grid section (27) to the second grid section (28).

4. The structural element (10) of claim 3 in which two of said connecting bodies (24) are positioned with their respective third grid section (29) connected to one another.

5. The structural element (10) of claim 3 in which two of said connecting bodies (24) are connected to one another by a reinforcing element (36).

6. The structural element (10) of claim 5 in which a plurality of said connecting bodies (24) of a first group (45) extend in a longitudinal direction (L) continuously along the structural element (10).

7. The structural element (10) of claim 6 in which a plurality of said connecting bodies (24) of a second group (47) extend in a transverse direction (Q) transverse to the longitudinal direction (L) between the connecting bodies (24) of the first group (45).

8. The structural element (10) of claim 1 in which each said connecting body (24) extends parallel to an edge (46, 48) of the structural element (10).

9. The structural element (10) of claim 1 in which the textile grid structure (25) is embodied as one of a knit, a woven fabric, a nonwoven fabric, a plait, or textile surfaces that are adhered to one another.

10. The structural element (10) of claim 1 in which said textile grid structure (25) includes glass.

11. The structural element (10) of claim 1 in which said textile grid structure (25) includes carbon fibers.

12. The structural element (10) of claim 1 in which the textile grid structure (25) of each connecting body (24) has a coating.

13. The structural element (10) of claim 1 in which the supporting shell reinforcement (17) consists of steel elements (18, 19, 20).

14. The structural element (10) of claim 1 in which the supporting shell reinforcement (17) consists of textile material.

15. The structural element (10) of claim 1 including an insulating layer (13) arranged between the supporting shell (12) and the facing shell (11).

16. The structural element of claim 1 in which said grid sections are formed with holes.

17. The structural element of claim 1 in which said grid sections are in the form of meshes.

18. A method for producing a structural element (10) comprising the steps of:

arranging a textile reinforcement (15) for a facing shell (11) of the structural element (10) on a formwork table (55), connecting to the textile reinforcement (15) a plurality of connecting bodies (24) each having a three-dimensional textile grid structure (25), wherein each said connecting body (24) has at least two grid sections (27, 28, 29) which extend in different spatial planes, pouring a first concrete layer (14), providing an insulating layer (13) between the connecting bodies (24) on the first concrete layer (14), arranging a supporting shell reinforcement (17) on said insulating layer (13), pouring a second concrete layer (16), and hardening the two concrete layers (14, 16).

* * * * *